United States Patent [19]

Hull et al.

[11] Patent Number: 4,964,644

[45] Date of Patent: Oct. 23, 1990

[54] PORTABLE HORSESHOE COURT

[76] Inventors: Harold L. Hull, 401 Canyon Way, Sp. 43, Sparks, Nev. 89434; John R. McCutcheon, 44 Main, Taylorsville, Calif. 95983

[21] Appl. No.: 435,159

[22] Filed: Nov. 13, 1989

[51] Int. Cl.[5] ..... A63B 67/00

[52] U.S. Cl. ..... 273/336

[58] Field of Search ..... 273/336, 337, 338, 339

[56] References Cited

U.S. PATENT DOCUMENTS

| | | | |
|---|---|---|---|
| 2,230,294 | 2/1941 | Heggie | 273/336 |
| 3,356,368 | 12/1967 | Dixon | 273/336 |
| 3,547,442 | 12/1970 | Fenicchia | 273/336 |
| 3,844,560 | 10/1974 | Litsch | 273/336 |
| 4,273,340 | 6/1981 | Hackett | 273/336 |
| 4,314,702 | 2/1982 | Updike et al. | 273/336 |
| 4,789,163 | 12/1988 | Warner et al. | 273/336 |

*Primary Examiner*—William H. Grieb

[57] ABSTRACT

A portable horseshoe pit which in its preferred embodiment is formed from a substantially rectangular base of POLYETHYLENE with a curved rubber backstop which is easily assembled and mounted to the base by L brackets which are in turn affixed to the base by hooks formed in one edge of the brackets which hook into slots formed in the base. The horseshoe stake is welded to a metal plate and the plate secured to the POLYETHYLENE base by having a similar hook formed in its front edge which hooks into a slot in the POLYETHYLENE base and all brackets and the plate holding the stake is then secured to the POLYETHYLENE base by a fastener through a hole in each of the brackets and a hole in the metal plate holding the stake. The POLYETHYLENE base may be fastened to the ground or other surface by driving spikes through holes provided in the base. The entire base may then be covered with clay or sand or the like.

7 Claims, 1 Drawing Sheet

PORTABLE HORSESHOE COURT

BACKGROUND OF THE INVENTION

Horseshoe courts in prior art are old and a number of devices have been taught to capture the horseshoes when they are thrown at two upstanding stakes that are positioned at a pre-determined distance apart. In some installations, U shaped boxes or frames extend around the stake forming a pit or the like and a stake is embedded in the ground and then surrounded by clay or the like while some form of backstop is sometimes provided.

Also, there have been provided portable horseshoe pits that are foldable such as U.S. Pat. No. 4,314,702 and that have an attachable stake, and some provide artificial surfaces such as a rubber surface or the like while others, such as U.S. Pat. No. 4,273,340, have provided a rubber pad and flexible support springs, while others, such as U.S. Pat. No. 3,547,442 provide a bag or mat centered between side walls and a stake projecting through the center of the bag or mat with the lower end of the stake being fastened to a support, which lies beneath the bag or mat.

While the prior art inventions have proved somewhat satisfactory, there are disadvantages that are overcome by the present invention, such as the means of providing the action of an authentic clay court with the portability of a portable court, and the principal improvement being in the method of mounting the stake and backstop to keep a realistic target and action for the horseshoes.

OBJECTS AND ADVANTAGES

It is a primary object of the present invention to provide a portable horseshoe court which has the action, feel, and appearance of a permanent court.

It is a further object to provide a portable court which has a base made of heavy plywood or polyethylene to which a metal base holding the stake can be easily affixed.

Still another object is to provide a simple means to removably attach a rubber back-stop to the base.

Another object is to provide means to affix the base to the playing surface to keep the two courts a predetermined distance apart.

Still another object is to provide a thin base as opposed to a box structure, which may be covered by clay or sand to provide a professional pit which is substantially the same height as the playing surface.

SUMMARY OF THE INVENTION

In accordance with the preferred embodiment of the present invention, a polyethylene base is provided with a pre-cut slot into which the metal base with the stake welded to it, is affixed, and other slots around the outer edges of the base receive support brackets to which a rubber backstop can be releaseably attached. The base also has one or more holes through which large spikes may be driven to hold the device in place on the ground or other playing surface. Also, when the two courts are set in place, they can now be covered with clay or sand or the like for a realistic professional court which may be used in tournaments or the like.

Other objects and advantages will become apparent when taken into consideration with the following drawings.

DETAILED DESCRIPTION OF THE DRAWINGS

Figure 1:
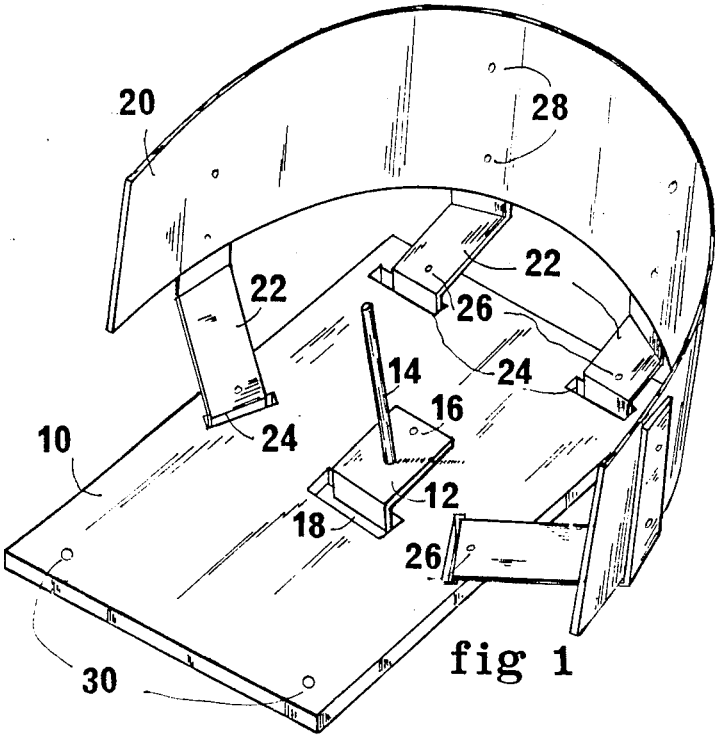
FIG. 1 is a perspective view of the court.
Figure 2:
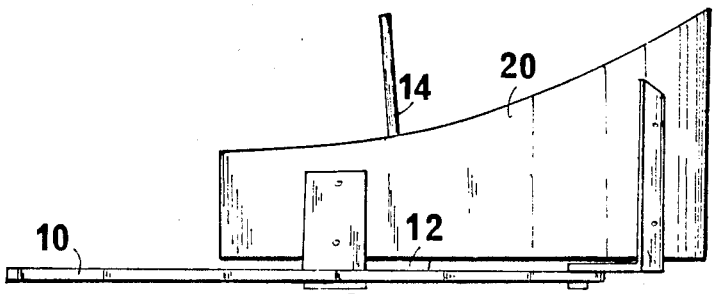
FIG. 2 is a side view of the court.
Figure 3:
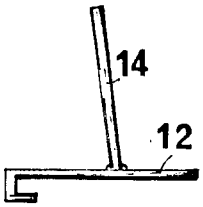
FIG. 3 is a side view of the stake and stake base.
Figure 4:
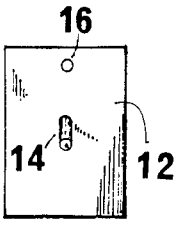
FIG. 4 is a top view of the stake and stake base.
Figure 5:
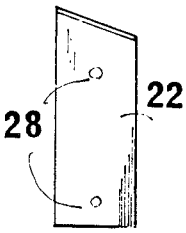
FIG. 5 is a top view of a typical backstop mounting bracket.
Figure 6:
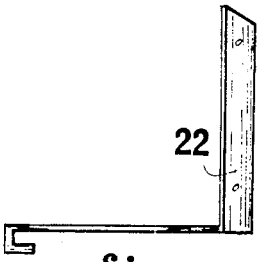
FIG. 6 is a perspective view of backstop mounting bracket.

Referring now in detail to the drawings whereby like numerals designate like parts throughout the various views, 10 is a base made of plyboard, polyethylene or other suitable material while 12 is a metal base to which stake 14 is welded or suitable attached while 16 is a mounting hole to affix the metal base 12 to base 10 which is then hooked and secured through slot 18. 20 is a backstop which is made of a material such as rubber belting or the like and is supported and mounted through holes 28 to brackets 22, brackets 22 being hooked and secured to base 10 through slots 24 and anchored to base 10 through mounting holes 26 with suitable fasteners (not shown). Base 10 may be anchored to the ground through holes 30 by spikes or pegs (not shown).

It will now be seen that we have provided a portable horseshoe court or pit which may be easily assembled and dis-assembled with simple bolts and wing-nuts (not shown) and then covered with clay or sand, and in operation has the action, feel and appearance of a permanent court. The rubber back-stop absorbs the shock of the horseshoes and the base is easily secured to the ground, lawn, earth, or parking lot by means of spikes driven through the holes in the base.

Although the invention has been herein shown and described in what is conceived to be the most practical and preferred embodiment, it is recognized that departures may be made therefrom within the scope of the invention, which is not to be limited to the details disclosed herein but it is to be accorded the full scope of the claims so as to embrace any and all equivalent devices and apparatus.

Having described our invention, what we claim as new and desire to secure by letters patent is:

1. A portable horseshoe pit for use in playing the game horseshoes comprising; A first base, said first base being substantially rectangular, a second metal base, means to releasably attach said second base to and above said first base, a metal stake, a backstop, said metal stake being secured at its lower end to said second base, said metal stake to extend above and slant forward at an angle to the vertical when said second base is releasably attached to said first base, means to releasably attach said first base to a surface, and means to releasably attach said backstop to said first base.

2. The devise of claim 1 in which said means to releasably attach said second base to and above said first base is by said second base having substantially a backward facing U formed beneath its front portion, said first base having a slot, said slot being located substantially in the center of said first base, said backward facing U of said second base cooperating with said slot to substantially hook said second base to said first base.

3. The devise of claim 2 in which said second base has at least one hole in its distal end through which a fastener may further secure said second base to said first base.

4. The devise of claim 1 in which said means to releasably attach said backstop to said first base is by at least two L shaped brackets.

5. The devise of claim 4 in which said L shaped brackets are formed with a backward facing U formed beneath the edge which is in proximity with said first base, said first base having multiple slots, said slots being located substantially at the outer edges of said first base, said backward facing U of said brackets cooperating with said multiple slots to substantially hook said brackets to said first base.

6. The devise of claim 5 in which said brackets have at least one hole through which a fastener may further secure said brackets to said first base.

7. The devise of claim 1 in which said means to releasably attach said first base to a surface is at least one hole in said first base through which a stake may be releasably driven into said surface.

* * * * *